US007819184B2

(12) United States Patent
Sachdeva et al.

(10) Patent No.: US 7,819,184 B2
(45) Date of Patent: Oct. 26, 2010

(54) LOGGING PLUG WITH HIGH INTEGRITY INTERNAL SEAL

(75) Inventors: Sandeep Sachdeva, Noida (IN); Marc McCorry, Aberdeen (GB); Andrew S. Ferguson, Chugiak, AK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 238 days.

(21) Appl. No.: 11/160,378

(22) Filed: Jun. 21, 2005

(65) Prior Publication Data

US 2005/0279494 A1 Dec. 22, 2005

(30) Foreign Application Priority Data

Jun. 22, 2004 (GB) ..... 0413909.3

(51) Int. Cl.
*E21B 33/12* (2006.01)

(52) U.S. Cl. ..... 166/191; 166/135; 166/116; 277/342; 277/589

(58) Field of Classification Search ..... 166/135, 166/191, 84.1, 115, 116, 77.1; 277/342, 277/589, 621
See application file for complete search history.

(56) References Cited

U.S. PATENT DOCUMENTS 2,825,590 A * 3/1958 Sutherland ..... 277/589
3,331,609 A * 7/1967 Moran ..... 277/567
4,524,998 A * 6/1985 Brisco ..... 285/101
4,875,615 A * 10/1989 Savard ..... 228/119
5,099,919 A * 3/1992 Schneider et al. ..... 166/188
5,579,841 A * 12/1996 Schneider et al. ..... 166/135
5,611,547 A * 3/1997 Baugh et al. ..... 277/336
5,775,422 A * 7/1998 Wong et al. ..... 166/135
5,819,846 A * 10/1998 Bolt, Jr. ..... 166/123
2002/0056965 A1* 5/2002 Pond ..... 277/530
2002/0189820 A1* 12/2002 Slup et al. ..... 166/385

FOREIGN PATENT DOCUMENTS

GB 2281088 A 2/1995
GB 2281088 A * 2/1995

* cited by examiner

*Primary Examiner*—David J Bagnell
*Assistant Examiner*—Sean D Andrish
(74) *Attorney, Agent, or Firm*—Rodney V. Warfford; Kevin B. McGoff; Bryan P. Galloway

(57) ABSTRACT

A logging plug is disclosed having an internal sealing mechanism therein which provides a high degree of sealing integrity between the bore of the plug and a coiled tubing or other means of suspending wellbore equipment running therethrough. The sealing mechanism utilizes a combination of low friction, elastomerically-energized cap seals and ring seals to ensure that the sealing surfaces adapt continuously to the changing profile of the coiled tubing to provide a true dynamic seal around the coiled tubing.

12 Claims, 1 Drawing Sheet

LOGGING PLUG WITH HIGH INTEGRITY INTERNAL SEAL

BACKGROUND OF THE INVENTION

The invention relates to logging plugs for use with coiled tubing in oil and gas and other wells. More particularly, the invention relates to internal sealing mechanisms for such logging plugs.

DESCRIPTION OF RELATED ART

Well operations often use coiled tubing to convey logging and other intervention tools downhole. In wells having bypass systems, the coiled tubing runs through the bypass tubing while simultaneously allowing wellbore fluids to flow to the surface in the annulus between the coiled tubing and the production tubing surrounding it above the bypass. To prevent wellbore fluids from being diverted into the bypass tubing, a logging plug is used in the bypass tubing to surround the coiled tubing therein. The logging plug is designed to seal both externally (static seal), between itself and the inner bore of the bypass tubing, and internally between the plug bore and the coiled tubing passing through it (dynamic seal).

This internal seal must be maintained to a high degree of integrity to prevent the backflow of wellbore fluids into the bypass tubing while permitting the coiled tubing to run freely in and out of the well. However, due to the nature of coiled tubing, which is often oval in cross-section and has a residual bend in the axial direction, the internal seals used in the past have comprised bushings. These bushings do not provide a full seal, but rather provide only a partial seal by creating a restricted flow path that allows some wellbore fluid to leak back into the bypass tubing and recirculate.

When the amount of wellbore fluid being produced is low, all or almost all of such fluid leaks through this recirculation path, and no fluid flows to the surface. This makes it impossible to log such wells in a flowing condition. Furthermore, when electrical pumps are in use downhole, this recirculation causes the pumps to overheat and suffer damage. A prior art logging plug with a bushing-type internal seal as described above is detailed in UK Patent Application GB 2 281 088 A, which is incorporated herein by reference.

There is therefore a need for a logging plug with an internal seal having a high degree of integrity to prevent recirculation of wellbore fluids through the bypass tubing during logging and intervention operations.

BRIEF SUMMARY OF THE INVENTION

The present invention comprises a logging plug having an internal sealing mechanism therein which provides a high degree of sealing integrity between the bore of the plug and a coiled tubing running therethrough. The sealing mechanism utilizes a combination of low friction, elastomerically-energized cap seals and ring seals to ensure that the sealing surfaces adapt continuously to the changing profile of the coiled tubing running through the seal mechanism to provide a true dynamic seal around the coiled tubing.

DETAILED DESCRIPTION OF THE INVENTION

Figure 1:
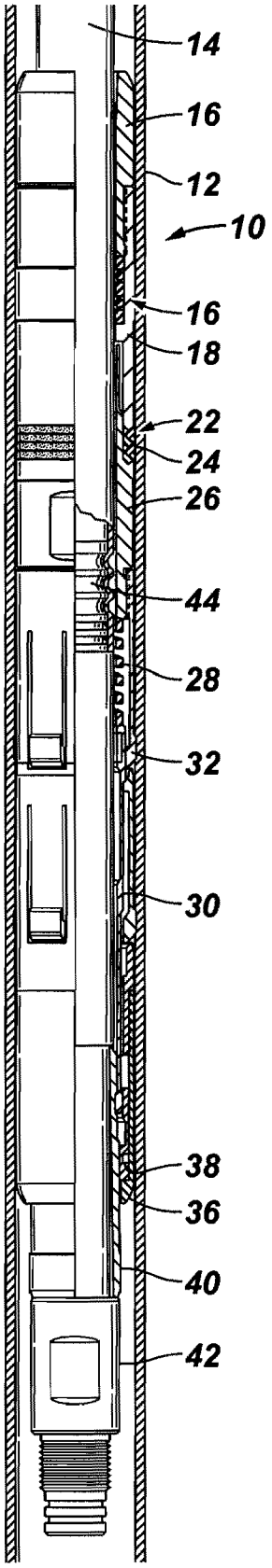
FIG. 1 is a partial cross-sectional view of a logging plug in accordance with the present invention deployed in a bypass tubing in a wellbore.

FIG. 1 illustrates generally at 10 a logging plug in accordance with the present invention that is deployed in a bypass tubing 12 in a wellbore and has a coiled tubing or other suspension means 14 running therein for conducting well logging or other intervention operations. The logging plug 10 comprises a top sub 16, an internal seal housing 18, and an internal seal assembly 20 therebetween for sealing between the coiled tubing 14 and the bore of the internal seal housing 18.

The logging plug 10 also includes an external seal assembly 22 for sealing between the exterior surface of the logging plug and the bore of the bypass tubing 12. The external seal assembly 22 consists of a number of vee ring seals 24, as is known in the art and is supported from the bottom by an external seal housing 26. A coil spring 28 abuts the bottom of the external seal housing 26 and further abuts an inner sleeve 30 at its opposite end. The coil spring 28 is contained within a support ring 32 which is mounted between external seal housing 26 and inner sleeve 30.

The lower body 34 of logging plug 10 surrounds inner sleeve 30 and extends to a bottom sub 36 in which a shear pin 38 is mounted. Shear pin 38 fixes the bottom sub 36 to retaining sleeve 40 until removal of the coiled tubing 14 from the bypass tubing 12 is commenced upon completion of the logging or well intervention operation. A crossover 42 is connected at 44 to the bottom of coiled tubing 14 internal to logging plug 10 and supports a well logging or well intervention tool at its downhole end.

Upon commencing a logging or well intervention operation, logging plug 10 carried on coiled tubing 14 is inserted into bypass tubing 12 until logging plug 10 seats in a polished nipple in the bore of bypass tubing 12. The external vee ring seals 24 then prevent wellbore fluids from passing around the exterior of logging plug 10 by engaging the bore of the bypass tubing 12.

Thereafter, the deployment of coiled tubing 14 into the wellbore continues as it passes through the bore of logging plug 10 which is now stationary within bypass tubing 12. Internal seal assembly 20 of the present invention, described more fully in connection with FIG. 2, ensures that there is at all times a high integrity seal between coiled tubing 14 and the bore of logging plug 10 to prevent wellbore fluids from recirculating into the bypass tubing 12 through this path during coiled tubing operations.

Figure 2:
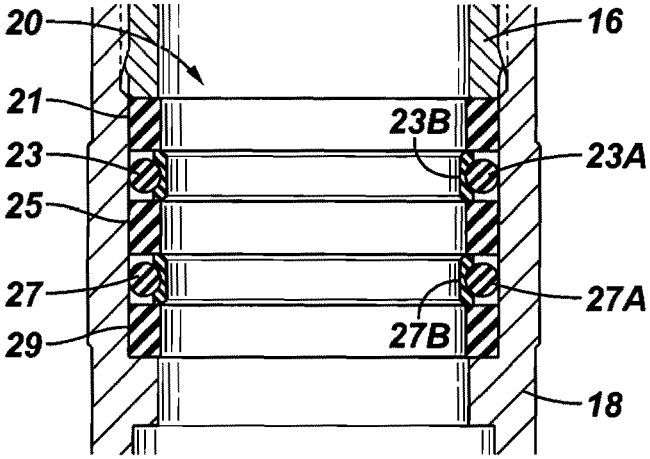
FIG. 2 is a cross-sectional view of the internal sealing mechanism of the logging plug of the present invention.

Turning now to FIG. 2, the internal seal assembly 20 of FIG. 1 is illustrated in cross-section without the coiled tubing 14 therein. Internal seal assembly 20 comprises an upper ring seal 21, an upper cap seal 23, a central ring seal 25, a lower cap seal 27, and a lower ring seal 29, each of which have substantially flat inner surfaces. In addition to its sealing function, each ring seal 21, 25, 29 aids in the retention of its adjacent cap seals(s), acts as a debris barrier, and serves as a bearing for the coiled tubing 14 moving through it. The ring seals 21, 25, 29 are formed of a low friction material such as PEEK, for example.

Cap seals 23, 27 are self-actuating and extrusion resistant. Each cap seal 23, 27 comprises a cap ring 23B, 27B surrounded in the seal bore by an elastomer o-ring 23A, 27A. The o-rings 23, A 27A are formed of a fluoroelastomer, for example, and cap rings 23B, 27B are formed of a premium grade PTFE, such as Avalon 89, for example. As the o-rings 23A, 27A are formed of an elastomer, they energize the cap seals 23, 27 to effect good contact between the cap rings 23B, 27B and the coiled tubing 14 at all times and regardless of any residual bending in the coiled tubing or distortion in its cross-section. It should be noted that cap seals 23, 27 may each comprise more than a single o-ring 23A, 27A when still further enhanced seal flexibility is required.

It will be recognized that while the embodiment of the present invention illustrated herein comprises three ring seals and two cap seals, any greater or lesser number of such seals may be employed in the logging plug as may be appropriate for the pressure conditions expected downhole. It will be further recognized that alternative arrangements of ring and cap seals may also be employed.

What is claimed is:

1. A logging plug for use in conjunction with coiled tubing for conducting operation in a well, the logging plug comprising:

a body having a bore therein for passing the coiled tubing therethrough;

a sealing mechanism within the bore for sealing between the coiled tubing and the body, wherein the sealing mechanism comprises a series of seals including an upper ring seal, adjacent an upper cap seal, adjacent a central ring seal, adjacent a lower cap seal, adjacent a lower ring seal;

wherein the upper ring seal, central ring seal and lower ring seal each have a flat inner surface configured to seal with an outer surface of the coiled tubing;

wherein the upper cap seal and lower cap seal each comprise a cap ring surrounded in the bore by an elastomer o-ring, the cap rings each having a flat inner surface configured to the seal with the outer surface of the coiled tubing;

wherein the series of seals, each having flat inner surfaces, defines an elongated inner sealing surface that adapts continuously along its length to changing profiles of the coiled tubing as the coiled tubing is run through the sealing mechanism, to thereby provide a dynamic seal around the coiled tubing.

2. A logging plug according to claim 1, wherein the elastomer o-ring comprises fluoroelastomer.

3. A logging plug according to claim 1, wherein at least one of the upper cap seal and lower cap seal comprises polytetrafluoroethylene.

4. A logging plug according to claim 1, wherein at least one of the upper ring seal, central ring seal and lower ring seal comprises polyetheretherketone.

5. A logging plug according to claim 1, wherein the logging plug comprises part of a system for conducting at least one operation in a wellbore.

6. A logging plug according to claim 5, wherein the system comprises the coiled tubing.

7. A logging plug according to claim 6, wherein each seal in the series of seals is located adjacent each other and adjacent the coiled tubing to provide the dynamic seal around the coiled tubing and between the coiled tubing and the body.

8. A logging plug according to claim 7, wherein the body comprises a top sub, an external seal housing, and an internal seal housing retaining the sealing mechanism for sealing between the coiled tubing and the internal seal housing.

9. A logging plug according to claim 8, wherein the system comprises a coil spring abutting a lower end of the external seal housing.

10. A logging plug according to claim 9, further comprising an external sealing mechanism sealing between the coiled tubing and the body.

11. A logging plug according to claim 10, wherein the body surrounds an inner sleeve and extends to a bottom sub.

12. A logging plug according to claim 11, wherein the bottom sub comprises a shear pin releasably connecting the logging plug to a retaining sleeve in the wellbore.

* * * * *